US006799945B2

(12) United States Patent
Chatel et al.

(10) Patent No.: US 6,799,945 B2
(45) Date of Patent: Oct. 5, 2004

(54) STATOR BLADE PIVOTING ARRANGEMENT IN A TURBOMACHINE

(75) Inventors: Alain Chatel, Vaux le Penil (FR); Fabrice Marois, Melun (FR); Dominique Raulin, Avon (FR)

(73) Assignee: Snecma Moteurs, Paris (FR)

( * ) Notice: Subject to any disclaimer, the term of this patent is extended or adjusted under 35 U.S.C. 154(b) by 64 days.

(21) Appl. No.: 10/354,971

(22) Filed: Jan. 31, 2003

(65) Prior Publication Data

US 2003/0147743 A1 Aug. 7, 2003

(30) Foreign Application Priority Data

Feb. 7, 2002 (FR) ..... 0201459

(51) Int. Cl.[7] ..... F04D 29/54
(52) U.S. Cl. ..... 415/156; 415/160; 415/162
(58) Field of Search ..... 415/155, 156, 415/159, 160, 161, 162, 148; 403/109.3, 359.4, 205, 187, 144

(56) References Cited

U.S. PATENT DOCUMENTS 4,668,165 A 5/1987 Ludwick
4,767,264 A 8/1988 Kisling et al.
5,024,580 A 6/1991 Olive
5,211,537 A 5/1993 Langston et al.
6,019,574 A * 2/2000 DiBella ..... 415/160

FOREIGN PATENT DOCUMENTS

| | | |
|---|---|---|
| DE | 2 029 859 | 2/1972 |
| EP | 0 545 656 | 6/1993 |
| EP | 1 156 227 | 11/2001 |

* cited by examiner

*Primary Examiner*—Edward K. Look
*Assistant Examiner*—Dwayne White
(74) *Attorney, Agent, or Firm*—Oblon, Spivak, McClelland, Maier & Neustadt, P.C.

(57) ABSTRACT

A spring (15) of angular shape is placed between the lug (17) of a connecting rod (10) controlling the orientation of a stator blade and the pivot (3) of said blade, such that its edge (18) bends against one edge face (19) of the connecting rod (10) and the washer (16) moves the pivot (3) in the play of the bore (21) of the connecting rod and sets and maintains the contact between two plane faces (12 and 13), so as to reduce the differences in angular displacements between the connecting rod and pivot due to the play remaining in the bore (21).

4 Claims, 2 Drawing Sheets

STATOR BLADE PIVOTING ARRANGEMENT IN A TURBOMACHINE

This invention relates to a stator blade pivoting arrangement in a turbomachine.

The stator blades, stationary in a turbomachine and used to rectify the gas flow before the next rotor blade stage, may be of the variable locking type, i.e. their orientation is controlled as a function of the operating mode of the machine. They are then mounted on outer pivots which project outside the stator casing and are connected to connecting rods rotated at will by a common control ring, surrounding the stator casing. The rotation of the connecting rods produces a similar rotation of the blades. The transmission of the rotation is acquired by a suitable adjustment liable to comprise mutual support of plane faces established on an end section of the pivot of the blade and on a bore at the end of the connecting rod: this end section and the bore are frequently squares.

The documents U.S. Pat. Nos. 4,767,264 and 4,668,165-A disclose connecting rod arrangements sufficiently thin to be flexible to the twisting to which they are subjected by the rotation of the control ring. These connecting rods are equipped with lateral ribs curved like tongs and which penetrate into the grooves of the pivots. These ribs are responsible for rotating the pivots with an engagement which is only slightly different to that of the square sections.

However, it is observed that the slightest adjustment play between the bore of the connecting rod and the pivot of the blade delays the rotational drive markedly, and a drive defect of several tenths of an angular degree is frequently reached. Since the blade should be oriented with great precision in order to obtain a good machine output, it can be concluded that an improvement is desirable to reduce the square adjustment play.

A solution is offered with the invention, which consists in its broadest definition of a stator blade pivoting arrangement in a turbomachine, comprising a blade pivot having one end projecting outside the stator and comprising a plane face section, and a control connecting rod engaged onto the end of the blade pivot via a bore limited by plane faces associated with the plane faces of the pivot, characterised in that it comprises a spring stressed between the pivot and the connecting rod and arranged so as to press one of the plane faces of the pivot against one of the plane faces of the connecting rod.

The above-mentioned documents do not clearly disclose the nature of the ribs, and in particular their rigidity. It is not stated that they have an elasticity which would be used to keep them in contact with the base of the grooves and ensure the angular position of the blade pivot with respect to the connecting rod with sufficient force.

The assemblies in these documents are also of a special type. The spring according to the invention is an autonomous part, distinct from the rest of the conventional square section assembly which does not need to be modified, the spring being simply added.

It is favourably envisaged that the springs will comprise a bored washer placed on the connecting rod and engaged around the end of the blade pivot, and a flexible edge of the washer, engaged on an edge face of the connecting rod opposite one of the faces of the pivot against which the washer abuts, making with the washer a wider angle than in the idle state of the spring.

The invention will now be described with reference to the figures, wherein.

Figure 1:
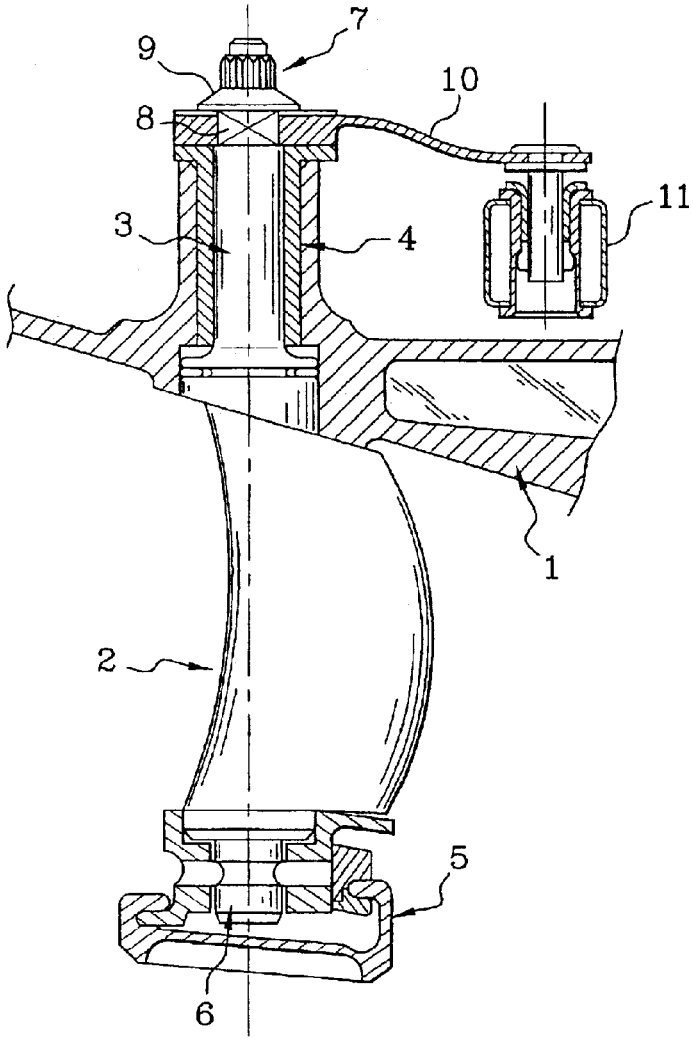
FIG. 1 is an overall view of the arrangement according to the invention.
Figure 2:
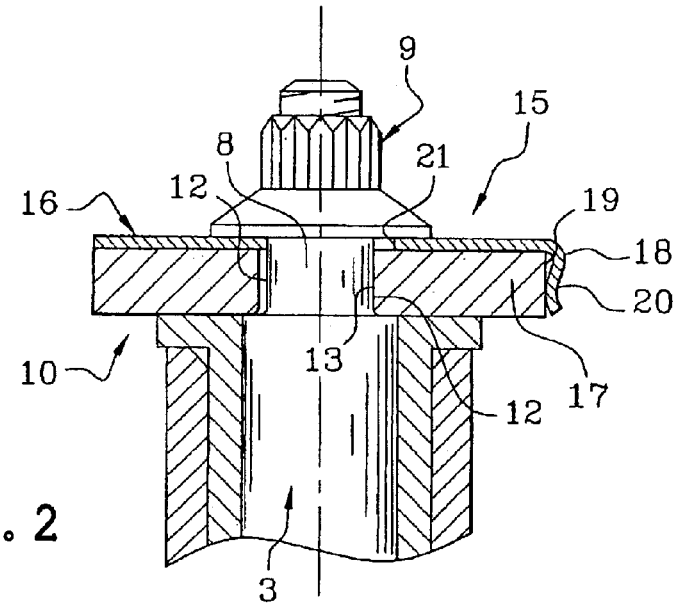
FIG. 2 is a more detailed view of the main components of the invention.
Figure 3:
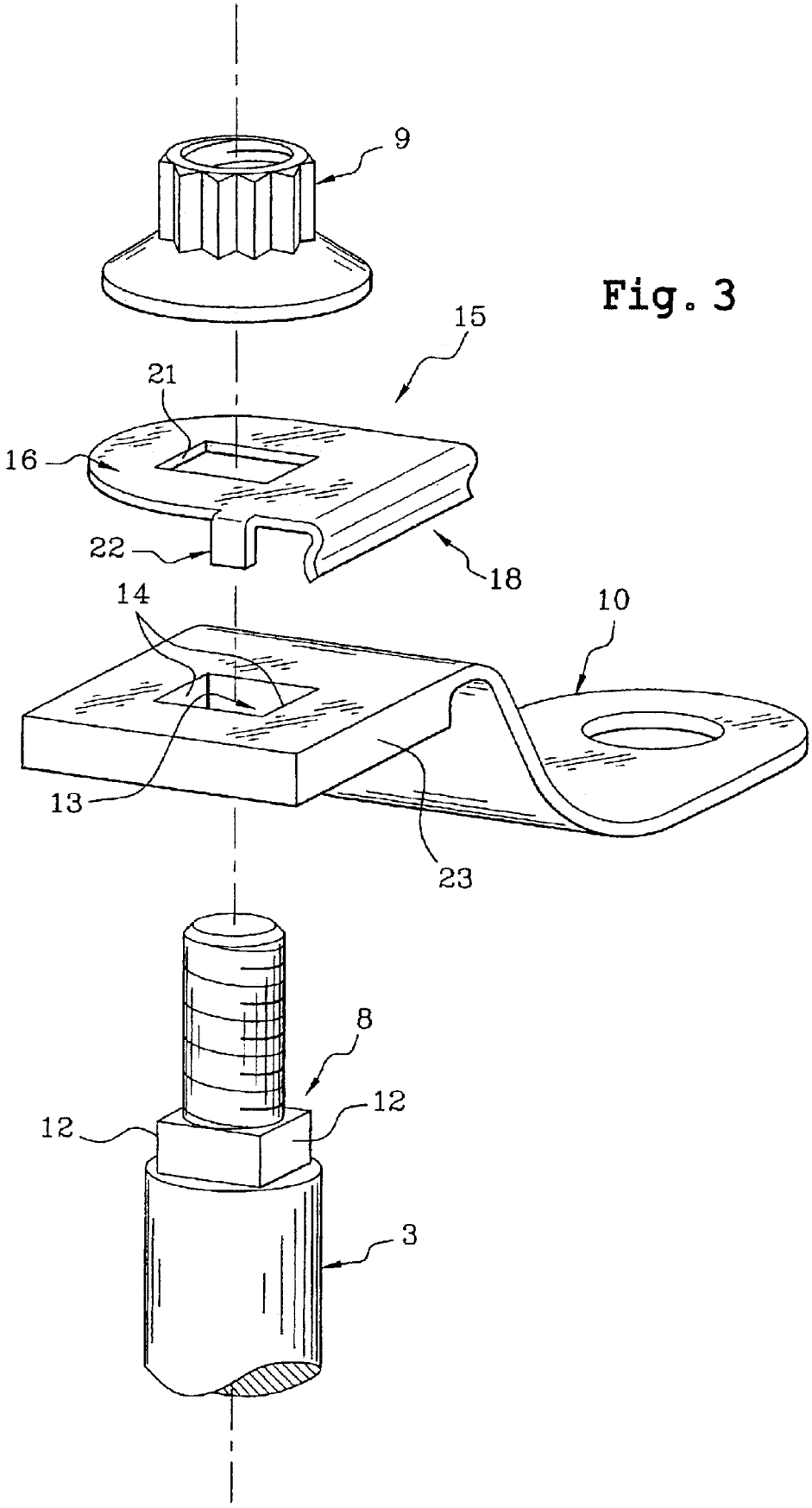
FIG. 3 is a blown-up view of said components.

With reference to FIG. 1, a turbomachine portion comprises a stator casing 1 comprising stationary blades 2 but which can be oriented by pivots 3, located at the outer ends of the blades 2 and in bearings 4 passing through the casing 1; the inner ends of the blades 2 are joined by a ring 5 engaged around an inner pivot 6 and which helps hold the circular stages of the blades 2 in place.

The pivots 3 pass through the stator casing 1 and end with an outer end 7 wherein one section 8 has a square shape. Further out, the end 7 is threaded and receives a nut 9. A connecting rod 10 is articulated between the end 7 and a control ring 11 around the stator casing 1 and at a close distance to the blade 2. The control ring 11 surrounds the stator casing 1, and it is rotated by known means such as cylinders according to the machine drive. It rotates the connecting rod 10 around the pivot 3, along with said pivot and the entire blade 2. Indeed, the connecting rod 10 comprises a square-shaped bore 13 at its end lug 17, and which comprises plane faces resting against the plane faces of the pivot 3 to rotate it. Two opposing plane faces of the pivot 3 have the reference 12, and the two corresponding plane faces of the bore 13 have the reference 14.

In accordance with the invention, a spring 15 is added to the device. It is separate from the other parts of the assembly, particularly the connecting rod 10 and the pivot 3, and it consists of a washer 16 placed on the lug 17 of the connecting rod 10 and an edge 18 roughly at a right angle with the washer 16 which extends along one lateral edge face 19 of the washer 16. The edge 18 comprises an undulation 20 oriented towards the lateral edge face 19 and wherein the top touches said face. A square bore 21 is provided via the washer 16. In addition, the proportions of the spring 15 are selected such that the edge 18 is pushed back when the bore 21 is engaged onto the square section 8 of the end of the pivot 3, while one of the edge faces of the bore 21 touches one of the plane faces 12 (opposite the lateral edge face 19) of the square section 8, and the plane face 12 of the square section 8 which is opposite the latter touches the complementary plane face 13 of the connecting rod lug 17. In other words, a tension is exerted on the spring 15, by means of which the angle of the washer 16 and the edge 18 is opened with respect to an idle state, and it is reflected by a contact pressure between a pair of plane faces 12 and 13 of the pivot 3 and the connecting rod 10, which persists during all the machine operating statuses. In this way, the connecting rod 10 and the blade 2 remain at a stationary mutual angular position.

All the blades 2 of the stage controlled by the ring 11 are equipped with a similar spring 15. It may be useful to check that all the springs 15 are mounted in the same way, to prevent differences in placement of the play between the bore 21 and the square section 8 of the pivot 3. For this it is possible to add a tab 22 to the spring 15, which is attached to the washer 16 and directed perpendicular to it like the edge 18 already encountered, but which is not intended to be deformed elastically when the spring is positioned, but to perform a fool-proof device function allowing positioning of the spring 15 only on one side. The tab 22 extends along the outer edge faces 23 of the connecting rod 10 when the spring 15 has been positioned correctly, but it prevents the washer 16 from resting on the lug 17 of the connecting rod 10 otherwise.

The invention would be practicable with other polygonal sections of the blade pivot and the connecting rod bore.

A very marked reduction in the angular drive defect of stator blades was observed by applying the invention.

What is claimed is:

1. Stator blade (2) pivoting arrangement in a turbomachine, comprising a blade pivot (3) having one end projecting outside the stator and comprising a plane face section (8), and a control connecting rod (10) engaged onto the end of the blade pivot via a bore limited by plane faces (13) associated with the plane faces (12) of the pivot, characterised in that it comprises a spring (15) stressed between the pivot and the connecting rod and arranged so as to press one of the plane faces of the pivot against one of the plane faces of the connecting rod.

2. Stator blade pivoting arrangement according to claim 1, characterised in that the spring comprises a bored washer (16) placed on the connecting rod and engaged around the end of the blade pivot, and a flexible edge (18) of the washer, engaged on an edge face of the connecting rod opposite one of the faces of the pivot against which the washer abuts, making with the washer a wider angle than in the idle state of the spring.

3. Stator blade pivoting arrangement according to claim 2, characterised in that the spring comprises a tab (22) engaged on another top edge face of the connecting rod.

4. Stator blade pivoting arrangement according to claim 2, characterised in that the edge of the spring is engaged on the edge of the connecting rod by an undulation (20).

* * * * *